United States Patent [19]

Widmer

[11] Patent Number: 4,560,145

[45] Date of Patent: Dec. 24, 1985

[54] AIR BAG JACK

[76] Inventor: Stanley W. Widmer, Sylvan Shores, Fawn Lake Dr., Browerville, Minn. 55438

[21] Appl. No.: 170,867

[22] Filed: Jul. 21, 1980

Related U.S. Application Data

[63] Continuation-in-part of Ser. No. 28,114, Apr. 9, 1979, abandoned.

[51] Int. Cl.[4] ..... B66F 3/24

[52] U.S. Cl. ..... 254/93 HP

[58] Field of Search ..... 92/34–35, 92/42; 267/65 A, 122; 254/93 HP

[56] References Cited

U.S. PATENT DOCUMENTS

| | | | |
|---|---|---|---|
| 1,698,164 | 1/1929 | Mallory | 92/34 |
| 2,180,128 | 11/1939 | Stancliffe | 92/42 |
| 2,725,578 | 12/1955 | Keller | 254/93 HP |
| 3,523,679 | 8/1970 | Clay | 254/93 HP |
| 3,565,398 | 2/1971 | Floria et al. | 254/93 HP |
| 3,695,582 | 10/1972 | Clay | 254/93 HP |

*Primary Examiner*—Robert C. Watson

*Attorney, Agent, or Firm*—Kinney & Lange

[57] ABSTRACT

An air bag jack comprising an inflatable member made of a flexible material with a uniform thickness having a top section and a plurality of lower annular sections. The sections sequentially taper in diameter and have a base diameter smaller than the base diameter of the section below forming a generally pyramidal shape enabling the sections to collapse within one another upon deflation into a compact form. The top and bottom annular sections have the ability to conform to the object being supported and the surface of the terrain that is being used. Further the top section's top end wall has a concave surface preventing slippage during inflation. There are also a plurality of rings, one between each pair of adjacent sections extending around the outside of the jack to provide annular support for the wall section adjacently above. Each ring has a half-circle cross sectional configuration to prevent thinning of the inflatable member's wall in the area of junction between sections. The jack is easily inflated by a 12 volt D.C. air pump powered from an automobile cigarette lighter.

6 Claims, 5 Drawing Figures

AIR BAG JACK

This application is a continuation-in-part of my copending application Ser. No. 28,114, filed Apr. 9, 1979 now abandoned.

BACKGROUND OF THE INVENTION

1. Field of the Invention

The present invention relates to pneumatic jacks and in particular to those pneumatic jacks that are made from a flexible material.

2. Prior Art

The prior art shows various types of pneumatic jacks, however, in each case the use of the jack has been limited by its design. In U.S. Pat. No. 3,695,582, a pneumatic jack is shown made of a hollow, flexible material. This jack has the disadvantage of not being able to conform to the surface of the object it is supporting, nor the ground on which it is resting. This limits the safe use of the jack to level or even terrain which may not be the case when a tire needs changing. Further, the base of the jack has the same diameter as the top, limiting the possible safe height that the jack can be designed for without making the diameters extraordinarily large to prevent possible tipping.

In U.S. Pat. No. 3,743,248 a pneumatic jack is also shown utilizing rigid telescoping tubing enclosed by a bellows. This jack also has the disadvantage of having a rigid top and bottom thereby not being able to conform to any surfaces. It also is limited as to the height that it can be collapsed to by the height of the rigid tubing.

U.S. Pat. No. 3,744,756 shows an inflatable bag used for lifting vehicles. The bag is reinforced with webbing to aid in retaining its shape.

U.S. Pat. No. 3,704,189 discloses a method of making a jack and discloses a barrel shaped collapsible bag as well as a tube shape.

A lifting device using an air bag between platforms is shown in U.S. Pat. No. 3,799,504.

SUMMARY OF THE INVENTION

The present invention consists of an inflatable member or chamber made of a flexible material having a top annular wall section and a plurality of lower annular wall sections. Each of the sections has a diameter smaller than the diameter of the section below it. Thus the sections form a pyramidal shape giving the jack stability when inflated and allowing it to collapse within the lowermost section.

There are a plurality of elastic rings located below the base of each section around the outside of the smallest tapered diameter. The rings have a half circle cross sectional configuration and are used to support the section that is immediately above as well as prevent excessive expansion in the junction region. The half circle cross sectional configuration eliminates thinning of the inflatable member's wall, preventing any possible rupture during inflation. When the inflatable member is deflated, the rings fall within each other guiding the orderly collapse of the sections into a compact form. The sections are each somewhat conical in cross section, but are curved inwardly toward the central axis of the member adjacent the upper or neck portion of each section.

The top section of the inflatable member has a transversely extending top end wall surface that may be concave. The concavity of the top end wall and the flexibility of the material of this upper surface allows this section to conform at least slightly to the configuration of the object that it is supporting.

The bottom wall of the lowest and largest of the inflatable member sections is also flexible and can conform to rough terrain, such as rocks and uneven ground surface, as is commonly the case in changing an automobile tire.

Further, the present invention is easily inflated by using a 12 volt D.C. air pump that can be plugged into the cigarette lighter of an automobile.

DESCRIPTION OF THE PREFERRED EMBODIMENT

Figure 1:
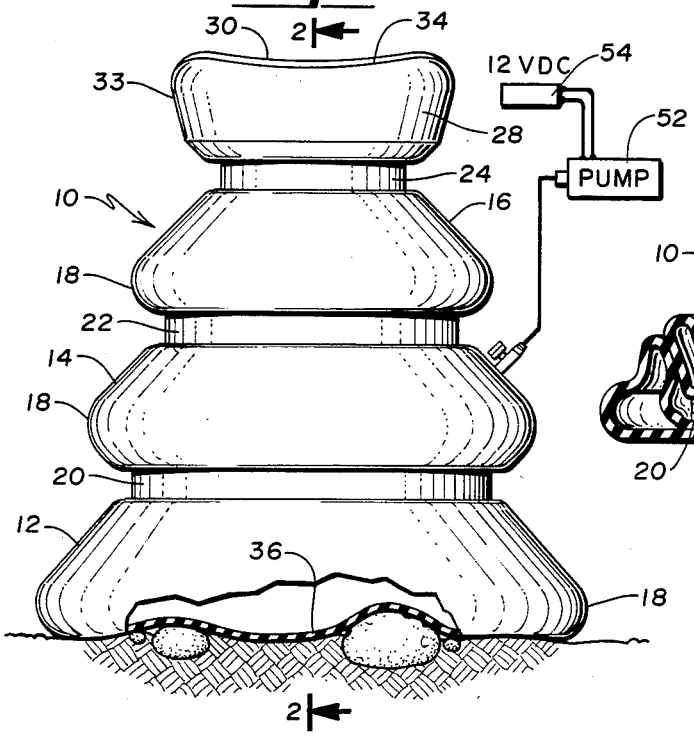
FIG. 1 is an elevational view of the inflatable jack of the present invention in working position.

Referring to the preferred embodiment in FIG. 1, an inflatable bag like member generally shown at 10 consists of four integral annular wall sections 12, 14, 16 and 28. The sections 12, 14 and 16 have a base diameter 18 from which said sections taper inwardly toward the central axis of the member toward the base of the section immediately above. Thus section 14 tapers inwardly and is necked until it reaches the base of section 16 and section 16 tapers inwardly to form a neck attached to the base of section 28. It should be understood that the inflatable member may comprise any number of sections joined together in airtight relation so they may be inflated.

Each base diameter 18 is smaller than the base diameter of the section immediately below but larger than the neck of the same section below.

Figure 3:
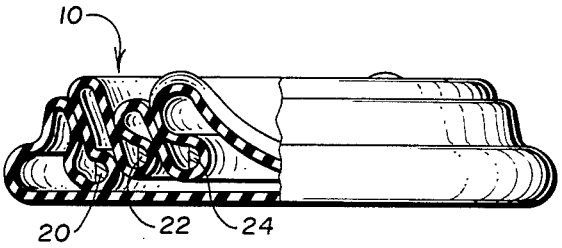
FIG. 3 is a partial cross sectional view of the present invention in a collapsed position.

The inflatable member, from the sequencing of sections 12, 14 and 16, has a generally pyramidal shape which gives the present invention stability when inflated. The pyramidal shape further allows the present invention to be collapsed upon deflation into a compact form as shown in FIG. 3. The compact form of the present invention is ideally suited for automobile use, since it can be stored in a minimum amount of space.

Figure 2:
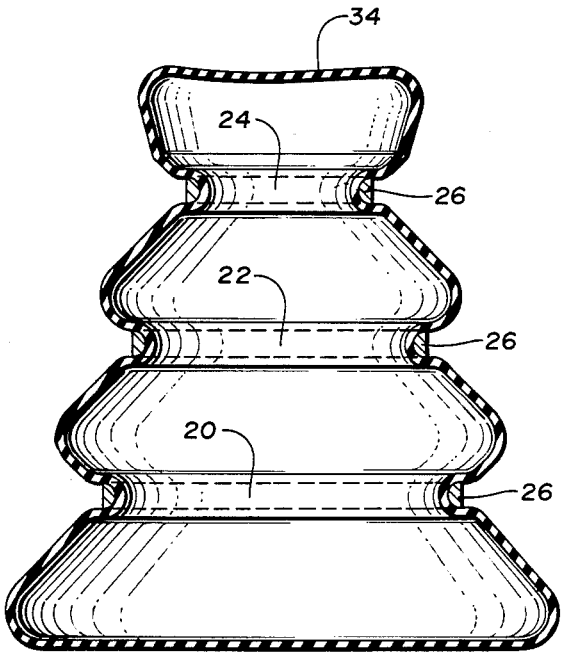
FIG. 2 is a cross sectional view taken on line 2—2 in FIG. 1.

The inflatable member 10 has a uniform thickness wall throughout all sections and can be rotationally molded from a flexible material such as a suitable elastomer, such as a vinyl plastic of about 70 durometer on the A scale. To provide support between the sections and to control bulges and stretching, elastic rings 20, 22 and 24 are included around the outside of the uppermost portion of each section 12, 14 and 16, providing support and size control for the section adjacently above. Referring to FIG. 2, each ring is shown to have a half circle, cross sectional configuration shown in FIG. 2. With the rounded side engaging the outside of the neck of each section, the rings provide support without the danger of the inflatable member "thinning" in the ring area when inflated. "Thinning" of the inflatable member could result in a rupture or bulge. The rings 26 are made of elastic or elastomeric material, such as neoprene rubber, for example in the range of 80 durometer.

Each ring 20, 22 and 24 is smaller than the one below as is the case for the base diameters of sections 12, 14 and 16. The difference in ring size adds to the orderly deflation of the inflatable member. Wherein ring 24 nests within ring 22 and ring 22 nests within ring 20. This is readily seen in FIG. 3.

Figure 5:
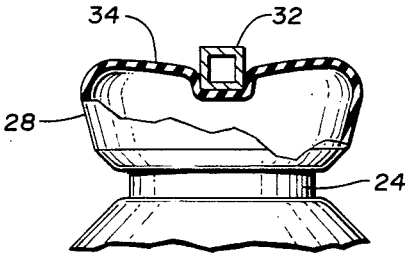
FIG. 5 is a fragmentary elevational view of the top section of the inflatable jack of FIG. 1 supporting an object.

Referring back to FIG. 1, the top section 28 tapers outwardly for a short distance from ring 24 and then forms a vertical cylindrical section 33 ending with a slightly concave upper end wall 34. The top wall 34 of top section 28 comes in contact with an object 32 to be supported or lifted. The concave upper end wall 34 tends to prevent the inflatable jack or member from slipping out from underneath the object to be supported until cylindrical section 28 generally conforms to the object to be supported such as a frame member 32, as shown illustratively in FIG. 5. A heat resistant pad 30 can be affixed to the exterior of the upper end wall 34 after molding to protect the inflatable member from hot spots such as car mufflers. The pad may be suitable asbestos fibers interspersed directly in the molded wall, or can be an asbestos pad added to the uniform thickness bag wall.

Referring back again to FIG. 1, a further advantage of molding the inflatable member with a uniform wall thickness is shown. The bottom end wall 36 of section 12 is sufficiently pliable so it conforms to rough terrain and remains stable.

Figure 4:
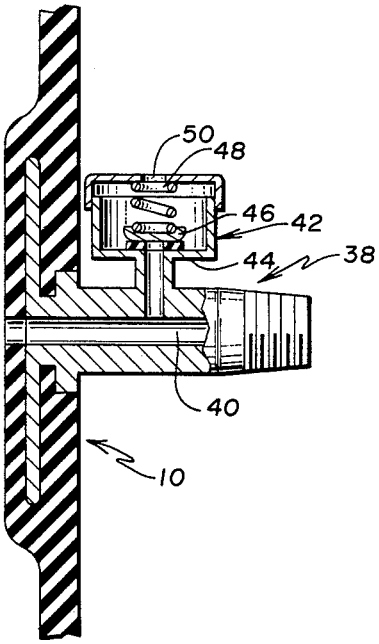
FIG. 4 is a fragmentary cross sectional view of a portion of the one type of inflation valve.

Referring to FIG. 4, the inflation valve shown generally at 38 is fixedly attached to the wall of inflatable member 18 in a desired location. The inflation valve 38 has a passageway 40 which has an inlet poppet valve constructed in the form of a normal automobile tire valve. A safety valve 42 is provided and includes a housing having a valve seat 44, a valve body 46, a spring 48 and an outlet aperture 50. The spring 48 holds the valve body 46 against the valve seat 44 with a force equal to the force derived on the valve body from the maximum pressure desired within the inflatable member 18. The seat 44 surrounds a passageway open to passageway 40.

In use, air under pressure is forced into inlet 40 to inflate the member 18, and valve 42 prevents excessive pressure build-up. It is to be understood that any conventional inflation means other than the one described may be used without departing from the spirit and scope of the invention.

Referring back to FIG. 1, the air may be pumped into the inflatable member 10 through valve 38 by a conventional air pump 52. The air pump 52 is preferably powered by a 12 volt D.C. source such as an automobile battery. There are pumps presently available which plug into the cigarette lighter of the car.

It should be noted that the collapsed inflatable member will fit under frames with very little clearance (see FIG. 3) because the sections nest down into the bottom section. Upon inflation the air pressure (which may be relatively low because of the large area of the member 18) starts to expand the member and the sections start to raise.

The full expanded height is shown in FIG. 1. By regulating the pressure the amount of extension of the sections can be controlled to raise a vehicle the desired amount. The deflation rate also can be controlled by permitting air to escape out valve 38 at a desired rate.

The rings are selected to stretch in diameter as the bag inflates to prevent thinning of the wall at the bands. The part circular cross section also reduces the likelihood of thinning. The diameter increase preferably is in the range of 10% to 20% of the at rest diameter when the bag is inflated at its rated working pressure (25–30 psi). For example at 25 psi, in a four section bag as shown having a molded at rest outside diameter of about 14.5 inches for the lower section and 7.5 inches for the O.D. of the upper section, the lower band 26 has an at rest O.D. of 9.56. The next highest band 26 has an at rest O.D. of 7.84 and the upper band 26 has an at rest O.D. of 4.84 inches. With 25 psi in the bag, the jack will support about 1500 pounds. The O.D. of the lower section will expand to about 15.3 inches and the bands 26 will stretch to about 11.0; 9.06 and 5.5 O.D., respectively. The bag is preferably 3/16 inches thick and 70 durometer vinyl plastic. Controlled expansion is the desired end. The neoprene rubber bands 26 thus stretch as the inflation pressure increases to control thinning in the neck areas and to also control the size of the bag. The air bag is molded in its 75% extended condition (75% of height under rated pressure). This also stops thinning (it does not have to stretch as much). The durometer of the rubber of rings 26 can be changed to control desired expansion.

Although the present invention has been described with reference to a preferred embodiment, persons skilled in the art will recognize the changes that may be made in form and detail without departing from the spirit or scope of the invention.

What is claimed is:

1. An air bag jack comprising:

an inflatable member made from a flexible, elastomeric material and having a wall with a substantially uniform thickness and having a top section, and a plurality of lower sections, all of the sections being integral with each other to form an airtight enclosure, the sections being nestable into the next lower section and each having a maximum base diameter smaller than the maximum base diameter of the section immediately below, the sections being joined to the next lower section by a neck portion;

a plurality of expandable elastic rings, each ring surrounding the neck portion of the flexible member between two adjacent sections and being of smaller diameter than the maximum base diameter of both of such two adjacent sections, said elastic rings expanding a controlled amount as the inflatable member is inflated for use to control elastic deformation of the inflatable member where the sections are joined thereby to provide yieldable size control for the adjacent sections as the member is inflated; and means for introducing a pressurized fluid into the interior of said inflatable member.

2. An air bag jack as described in claim 1 wherein the means for allowing the pressurized fluid to enter is an automotive type valve stem.

3. An air bag jack as described in claim 2 including a safety valve comprising a diaphragm, a diaphragm seat, a spring holding said diaphragm against the seat, said spring having a force equal to the pressure desired in said inflatable member, and an outlet opening.

4. The air bag jack of claim 1 wherein the inflatable member is rotationally molded at approximately 75% of its size after being fully inflated.

5. An air bag jack as described in claim 1 wherein said rings each have an inner surface which is part circular in cross section and which engages the wall of the flexible member in the neck portion.

6. The air bag jack as claimed in claim 5 wherein the rings are made of elastomeric material and are of size and elasticity to stretch in diameter between 10% 20% of their at rest diameter when the inflatable member is inflated to a normal working pressure.

* * * * *